United States Patent [19]

Frederick et al.

[11] 4,354,318

[45] Oct. 19, 1982

[54] ATHLETIC SHOE WITH HEEL STABILIZER

[75] Inventors: Edward C. Frederick, Missoula, Mont.; Joseph J. Murphy, Biddeford, Me.; James T. Gorman; Steven J. Burris, both of Exeter, N.H.

[73] Assignee: BRS, Inc., Beaverton, Oreg.

[21] Appl. No.: 179,822

[22] Filed: Aug. 20, 1980

[51] Int. Cl.[3] ..... A43B 13/12; A43B 23/08

[52] U.S. Cl. ..... 36/30 R; 36/69

[58] Field of Search ..... 36/30 R, 68, 69, 25 R, 36/17

[56] References Cited

U.S. PATENT DOCUMENTS

| | | | |
|---|---|---|---|
| 2,405,870 | 8/1946 | Almy | 36/25 |
| 3,046,679 | 7/1962 | Maertens et al. | 36/17 |
| 4,128,950 | 12/1978 | Bowerman et al. | 36/30 R |
| 4,259,792 | 4/1981 | Halberstadt | 36/30 R |
| 4,288,929 | 9/1981 | Norton et al. | 36/69 |

*Primary Examiner*—Patrick D. Lawson

*Attorney, Agent, or Firm*—Schuyler, Banner, Birch, McKie & Beckett

[57] ABSTRACT

An athletic shoe (10) having an upper (12) and a sole (14) is disclosed. The sole (14) includes an intermediate sole layer (16) of a resilient cushioning material. A bead (46) is disposed about the perimeter of the shoe in the heel spring section to enhance the heel stability.

17 Claims, 6 Drawing Figures

ATHLETIC SHOE WITH HEEL STABILIZER

TECHNICAL FIELD

The present invention relates to athletic shoes, and in particular, to a heel stabilizer used with the shoe.

BACKGROUND OF THE INVENTION

Shoes of the prior art have frequently incorporated into the shoe upper heel counters, i.e., a stiffener to give form to a shoe upper around the area of the heel. In athletic shoes, wherein the shoe is subjected to more vigorous motion than a normal walking shoe, counters have been subject to premature fatigue. The fatigue can result in loss of rigidity of the counter, splitting of the counter, or breaking away of the counter from its juncture to the sole. As the heel counter fatigues, heel stability, i.e., the capability of the shoe to exert a stabilizing influence on the foot in the area of the heel, particularly in the lateral direction, may lessen.

It is believed that the fatigue of heel counters is caused by excessive motion of the rear foot by some runners, and the tendency of some runners to pronate, i.e., to roll the foot inwardly during running. The problem of heel counter fatigue and the need for the heel stability is even more acute with heavier athletes. Furthermore, the problem of heel counter fatigue and the need for greater heel stability increases when relatively thick cushioning intermediate sole layers are incorporated into the athletic shoe. Thick intermediate cushioning sole layers are frequently used in present day running and jogging shoes.

SUMMARY OF THE INVENTION

The present invention is directed to an athletic shoe. The shoe includes an upper which has an outer surface and an inner surface. The shoe upper includes a heel spring section and a toe spring section. A sole, including an outer sole layer, is secured to the upper. The outer sole layer has an upper major surface connected to the shoe upper and a lower major surface which faces the ground. An external portion of the upper major surface of the outer sole layer, at least in the heel spring section, extends beyond the area where the sole is secured to the upper. A bead is secured between the outer surface of the upper and the external portion of the outer sole area. The bead extends around only the heel spring section for enhancing heel stability.

In a preferred embodiment, an intermediate sole layer is interposed between the upper major surface of the outer sole layer and the upper. The intermediate sole layer is formed of cushioning resilient material having a hardness less than the hardness of the outer sole layer. The intermediate sole layer also has an external portion of its upper major surface which extends beyond the area of juncture between the shoe upper and the sole. The sole is secured to the upper major surface of the intermediate layer. The bead is preferably formed of a resilient material and is attached to the external portion of the intermediate sole layer. The bead is disposed around the entire perimeter of the heel counter and at an area where it is believed the greatest stress is placed upon the heel counter. That is, adjacent an area where the upper is joined to the intermediate sole area.

By utilizing a heel stabilizer of the present invention, the heel stability of the shoe is enhanced. By locating the heel stabilizing bead only in the heel spring section of the shoe, the tendency for excessive motion is reduced in this area, while permitting or transferring excessive motion to the toe spring section. The utilization of a heel stabilizing bead in accordance with the present invention may lessen the tendency of certain runners to pronate, provide additional lateral support, and act as a barrier to excessive lateral forces of the rear foot. The heel stabilizing bead also tends to preserve the heel counters' original shape and strength and, hence, alleviate to a substantial degree the premature fatigue of the counter.

Various advantages and features of novelty which characterize the invention are pointed out with particularity in the claims and annexed hereto and forming a part thereof. However, for a better understanding of the invention, its advantages, and objects obtained by its use, reference should be had to the drawings which form a further part hereof and to the accompanying descriptive manner in which there is illustrated and described preferred embodiments of the invention.

DETAILED DESCRIPTION OF THE INVENTION

Figure 1:
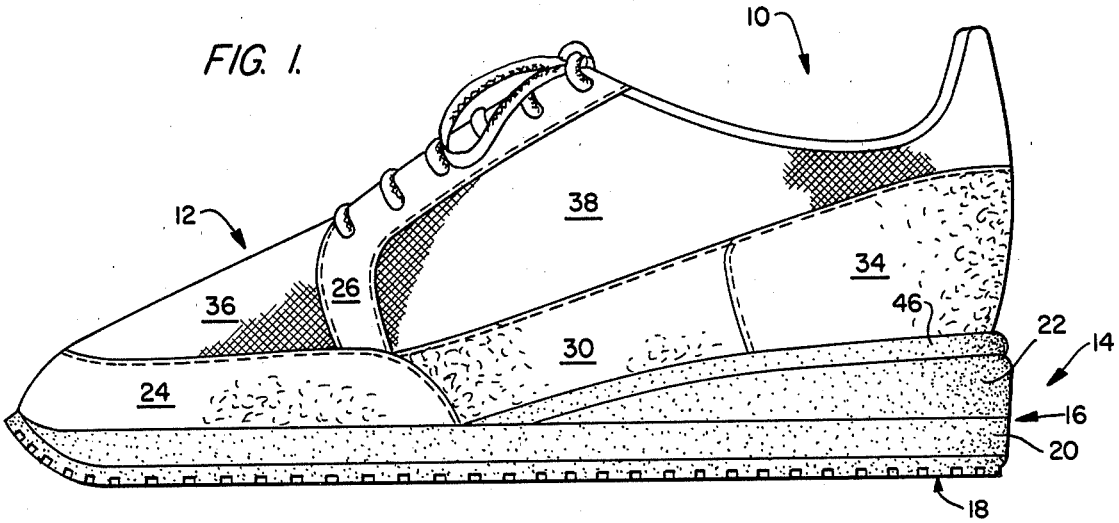
FIG. 1 is a side elevational view of a first side of an athletic shoe in accordance with the present invention.

Referring to the drawings in detail, wherein like numerals indicate like elements, there is shown in FIG. 1 an athletic shoe in accordance with the present invention designated generally as 10. The shoe 10 includes an upper 12 and a sole 14 secured below it. The sole 14 is made up of an intermediate sole layer 16 and an outer sole layer 18. The intermediate sole layer 16 is in turn broken down into a base layer 20 and a heel lift layer 22. The outer sole layer 18 is preferably made of a hard resilient and flexible wear resistant material, such as rubber or other comparable synthetic material. The base and heel lift layer 20, 22 of the intermediate sole layer 16 are made of a cushioning resilient material having a hardness less than that of the outer sole layer 18, and preferably within the range of approximately 35 to 55 durometers on the Shore A scale.

Figure 2:
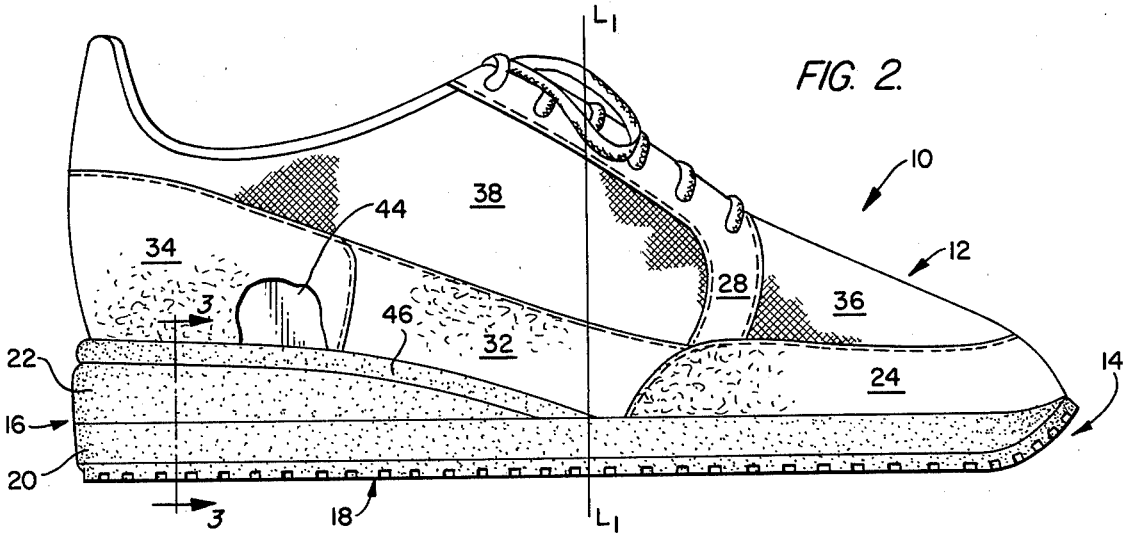
FIG. 2 is a side elevational view of the other side of an athletic shoe in accordance with the present invention.
Figure 4:
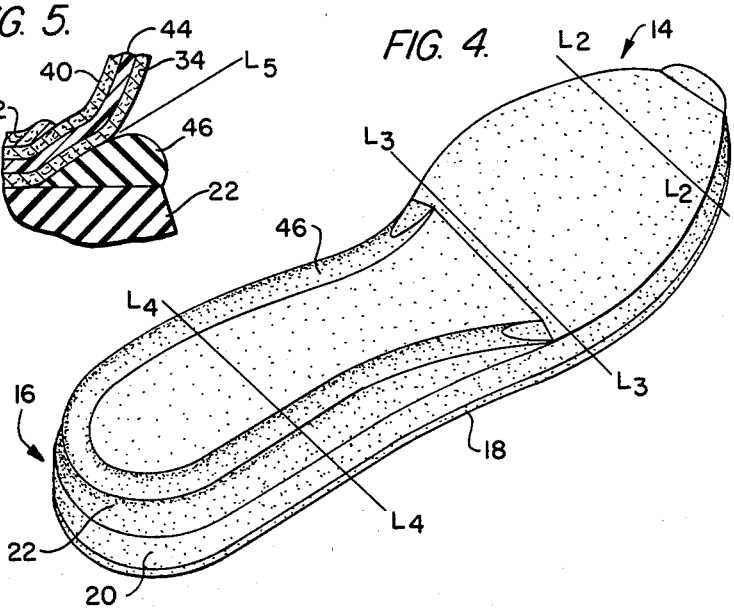
FIG. 4 is a perspective view illustrating a heel stabilizing bead attached to the sole of a shoe.

The shoe 10 can be divided into various sections in several manners. One method is to define the sections in accordance with the areas defined around the last upon which a shoe is formed. As seen in FIG. 2, line $L_1$ extends through the shoe 10. The area forward of line $L_1$ is generally referred to as the toe spring section and the area rearward of line $L_1$ is generally referred to as the heel spring or heel height section. In relation to the foot, the heel spring section is generally the area behind the ball of the foot. Another manner of dividing the shoe into various sections is seen in FIG. 4. Lines $L_2$, $L_3$, and $L_4$ divide the sole 14 and shoe 10 into four sections which relate to four areas of the foot. The area forward of line $L_2$ can be referred to as the toe section. The area between lines $L_2$ and $L_3$ can be referred to as the forefoot section, and the area between lines $L_3$ and $L_4$ can be referred to as the arch section. The area rearward of line $L_4$ can be referred to as the heel section.

As seen in FIGS. 1 and 2, the outer surface of upper 12 is formed of a plurality of sections of material 24, 26, 28, 30, 32, 34, 36 and 38 sewn together as indicated by dashed lines. The location, configuration and number of the various sections of material 24–38 can be varied for structural and design reasons. The various sections of material 24–38 can be made of the same or varying materials, again for either functional or design purposes. As illustrated, sections of material 26–34 are formed of a first material, such as leather, and sections of material 36, 38 are made of a second synthetic material.

Figure 5:
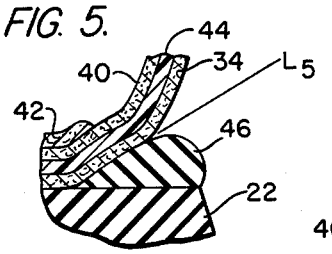
FIG. 5 is an enlarged sectional view of a portion of FIG. 3 encircled by line 5.
Figure 3:
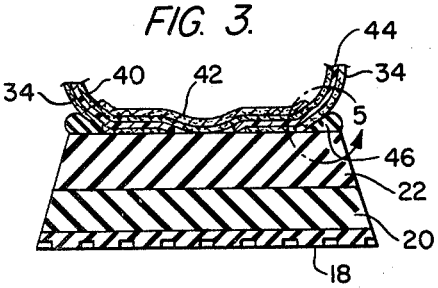
FIG. 3 is a sectional view taken generally along line 3—3 of FIG. 2.

In addition to being segmented, the upper 12 is made up of a plurality of layers. As seen in FIGS. 3 and 5, the section of material 34 is attached, preferably by an adhesive, to the upper surface of heel lift layer 22. One or more internal layers of material, such as layers 40, 42, are secured to the outer layer of material of upper 12. The internal layers 40, 42 are attached to adjacent parts of the upper 12 in a suitable fashion. For example, layer 40 is attached to the section of material 34 by the sewn lines shown in FIGS. 1 and 2, and to the heel lift layer 22 by an adhesive. The layer 42 is attached to an upper surface of the layer 40 by an adhesive.

A heel counter 44 is disposed between the section of material 34 and the internal layer 40. The heel counter 44 is made of a relatively stiff material to provide form and stability of the upper 12 in the area surrounding the heel. The heel counter 44 is received within and extends completely throughout the section of material 34. The heel counter 44 extends from an inside edge of the upper 12 adjacent the rear of the arch section, around the inside edge and around the back of the heel section to the outside edge of the upper 12. On the outside edge of the upper 12, the counter 44 also extends generally to the area adjacent the rear of the arch section. In vertical height, the counter 44 extends upward from the heel lift layer 22 to approximately two-thirds the height of the upper 12. The counter 44 gradually increases in height proceeding in a rearward direction. It should be understood that heel counters of other size and shape are contemplated by the present invention, so long as they perform the conventional function of a heel counter.

As was discussed above, heel counters in athletic shoes are frequently subject to premature fatigue. To alleviate this problem and to enhance the heel stability, a bead 46 is attached to an upper surface of the intermediate sole layer 16. A portion of heel layer 22 extends external of the area where the sections of material 30, 32 and 34 of upper 12 are joined to it. The heel lift layer 22 thus has an external major surface disposed outside the outer surface of the upper 12. This external major surface extends around the perimeter of the upper 12 in the heel and arch sections. The bead 46 is attached to this external major surface. The forwardmost portions of the bead 46 are attached to similar external major surfaces of base layer 20. The bead 46 extends along the perimeter of the shoe 10 along its inside, outside and rear edges of the heel spring section. The bead 46 promotes heel stability and preserves the heel counter's original shape and strength. By locating the bead 46 adjacent the area where the upper 12 joins the intermediate layer 16, the bead 46 is disposed by the area where stress concentrates on the counter 44 and provides support for the counter at this stress area. The bead 46 also acts as a barrier to excessive lateral forces of the rear foot.

Figure 6:
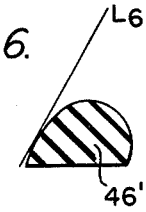
FIG. 6 is a sectional view of another embodiment of a heel stabilizing bead in accordance with the present invention.

The bead 46 has a flat bottom surface which is adhesively attached to the external major surfaces of heel lift layer 22 and base layer 20. The bead 46 has an outer curved surface and a upper surface which slopes downwardly and inwardly from the outer surface. The bead 44 thus takes on a wedge-shaped configuration with the inwardly sloping surface fitting generally under an outer surface of the shoe upper 12. The inwardly sloping surface is disposed at a particular angle to accommodate a particular shoe upper. As seen in FIGS. 3 and 5, with reference to lines $L_5$ and $L_6$, the inwardly sloping surface is angled at approximately 30° above the horizontal. This slope can vary from approximately 30° to approximately 60° above the horizontal. A slope approximately 60° in the alternate bead 46′ is shown in FIG. 6. Also, as seen in FIGS. 5 and 6, the inwardly sloping surfaces of the beads 46, 46′ are curved and the angle of the slope is an approximation taken as a tangent from approximately the center of the curved inwardly sloping surface. The particular angle of the slope is determined by the particular upper with which the bead is used. A bead with a width of approximately one-half inch and a thickness of one-quarter inch has been found suitable.

The bead 46 is preferably shaped from a strip of resilient material, such as foam rubber, ethylene vinyl chloride, (EVA), or extruded plastic. The bead 46 preferably has a hardness between 30 and 75 durometers on the Shore A scale with a range of 35 to 45 durometers on the Shore A scale found to be especially suitable.

In the embodiment shown, heel lift layer 22 is shown disposed above base layer 20. It should be understood that the disposition of these layers could be reversed wherein a major portion of the bead 46 would be attached to a base layer. An intermediate sole layer 16 with a thickness of approximately one inch in the heel section has been found suitable in one embodiment of the invention.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention, to the full extent indicated by the broad general meaning of the terms in which the appended claims are expressed.

We claim:

1. An athletic shoe comprising:

a shoe upper having an outer surface and an inner surface, said shoe upper including a heel spring section and a toe spring section;

a sole secured to said upper, said sole including an outer sole layer with an upper major surface and a lower major surface, an external portion of the upper major surface of said outer sole layer extending, at least one said heel spring section, beyond the area where said sole is secured to said upper;

said upper including a heel counter supported in said heel section; and a bead for enhancing heel stability secured between the outer surface of said upper and said external portion of said outer sole area, said bead extending around only the perimeter of said heel spring section and having a generally wedge-shaped cross-section with an upwardly facing surface terminating at an inner edge a short distance inward of the outer perimeter of the upper major surface of said sole and forming the only contact surface of said bead with said upper, the bead forming a resilient support body for said counter along the area of maximum stress on said counter during running.

2. An athletic shoe in accordance with claim 1, wherein said generally wedge-shaped cross-section configuration of said bead includes a flat bottom surface and said upwardly facing surface slopes downwardly and inwardly.

3. An athletic shoe in accordance with claim 2, wherein the downwardly and inwardly sloping surface is disposed generally at an angle between 30° and 60° above the horizontal.

4. An athletic shoe in accordance with claim 1, 2 or 3, wherein the bead is formed of a resilient material and has a hardness within the range of 30 to 75 durometers on a Shore A scale.

5. An athletic shoe in accordance with claim 4, wherein said material of said bead has a hardness within the range of 35 to 45 durometers on a Shore A scale.

6. An athletic shoe in accordance with claims 1, 2 or 3, including an intermediate sole layer of resilient cushioning material disposed between said outer sole layer and said upper, said intermediate sole layer having an upper major surface attached to said upper, said upper major surface of said intermediate sole layer having an external portion extending beyond the area where said upper is attached to said intermediate sole layer, said bead being attached to said external portion of said intermediate sole layer.

7. An athletic shoe in accordance with claim 6, wherein said intermediate sole layer includes a heel lift layer.

8. An athletic shoe in accordance with claim 6, wherein said intermediate sole layer has a hardness within approximately 35 to 55 durometers on the Shore A scale.

9. An athletic shoe comprising:

a shoe upper having an outer surface and an inner surface, said shoe upper including a heel section, an arch section, a forefoot section, and a toe section;

a sole secured to said upper, said sole including an outer sole layer with a ground contact surface and an intermediate sole layer secured between said outer sole layer and said upper in at least said heel section, said outer sole layer being formed of resilient material having a first hardness, said intermediate sole layer being formed of a resilient cushioning material of a second hardness less than said first hardness;

said upper including a heel counter;

said upper being joined to said intermediate layer, said intermediate layer having an external surface extending outwardly beyond the area where it is joined to said upper;

a wedge-shaped bead formed of a resilient material and secured between said external surface of said intermediate layer and the outer surface of said upper about the perimeter of said heel counter for enhancing heel stability, said wedge-shaped bead having an upper surface sloping inward and downward at an angle approximately between 30° and 60° above horizontal and terminating at a lower inner edge a short distance inward of the outer perimeter edge of the external surface of said intermediate sole layer, said wedge-shaped bead including a generally flat bottom surface extending outward from said inner edge and a side surface extending from said flat bottom surface to said upper surface, the entire body of said wedge-shaped bead being formed between said upper, flat and side surfaces, said upper surface contacting said upper substantially along the area of maximum stress on said counter during running so that the body of said wedge-shaped bead forms a resilient support for said counter along said area of maximum stress.

10. An athletic shoe in accordance with claim 9 wherein said heel counter extends around both sides and the rear of said heel section and said bead is disposed along the entire extent of said heel counter.

11. An athletic shoe in accordance with claim 9 wherein said resilient material which forms said bead is selected from the group comprised of foam rubber, ethylene vinyl acetate and extruded plastic.

12. An athletic shoe in accordance with claim 9 or 11 wherein said resilient material from which said bead is formed has a hardness in the range of approximately 30 to 75 durometers in the Shore A scale.

13. An athletic shoe in accordance with claim 12 wherein said resilient material from which said bead is formed has a hardness in the range of approximately 35 to 45 durometers on the Shore A scale.

14. An athletic shoe in accordance with claim 9 or 10 wherein said bead extends only in said arch and heel sections.

15. An athletic shoe comprising:

a multi-layered shoe upper having an outer surface and an inner surface, said shoe upper including a heel spring section and a toe spring section;

a sole secured to said upper, said sole including an outer sole layer with a major ground contact surface and an intermediate sole layer secured between said outer sole layer and said upper along substantially the entire length of said outer sole layer, said outer sole layer being formed of a resilient material having a first hardness, said intermediate sole layer being formed of a cushioning resilient material of a second hardness less than said first hardness, said second hardness being within the range of approximately 35 to 55 durometers on the Shore A scale;

said upper including a heel counter disposed between two layers of said multi-layered upper;

said upper being joined to said intermediate layer, at least in said heel spring section said upper and intermediate layer being joined directly to one another along substantially the entire horizontal extent of said upper, said intermediate layer having an external surface extending outwardly beyond the area where it is joined to said upper;

a bead for enhancing heel stability, said bead being secured between said external surface of said intermediate layer and the outer surface of said upper about only said heel spring section, said bead having a wedge-shaped cross-section with a flat base and an inwardly sloping upwardly facing surface in contact with said upper, said flat base being attached to said external surface of said intermediate layer and having an inner terminal end adjacent the point where said upper ceases to be joined to said intermediate layer, said bead being formed of a resilient material having a hardness within the range of approximately 30 to 75 durometers on the Shore A scale.

16. An athletic shoe in accordance with claim 9 wherein said side surface is curved.

17. An athletic shoe comprising:

a shoe upper having an outer surface and an inner surface, said shoe upper including a heel section, an arch section, a forefoot section, and a toe section;

a sole secured to said upper, said sole including an outer sole layer with a ground contact surface and an intermediate sole layer secured between said outer sole layer and said upper in at least said heel section, said outer sole layer being formed of a resilient material having a first hardness, said intermediate sole layer being formed of a resilient cushioning material of a second hardness less than said first hardness;

said upper including a heel counter;

said upper being joined to said intermediate layer, said intermediate layer having an external surface extending outwardly beyond the area where it is joined to said upper;

a wedge-shaped bead formed of a resilient material and secured between said external surface of said intermediate layer and the outer surface of said upper and the perimeter of said heel counter for enhancing heel stability, said wedge-shaped bead having an upper surface sloping inward and downward to terminate at a lower inner edge a short distance inward of the outer perimeter edge of the external surface of said intermediate sole layer, said wedge-shaped bead including a generally flat bottom surface extending outward from said inner edge and a side surface extending from said flat bottom surface to said upper surface, an uppermost end of said bead being located below the level where said upper begins its substantially vertical extent.

* * * * *